US009760038B2

(12) United States Patent
Yoshii

(10) Patent No.: US 9,760,038 B2
(45) Date of Patent: Sep. 12, 2017

(54) TONER CASE, AND IMAGE FORMING APPARATUS INCLUDING THE SAME

(71) Applicant: KYOCERA Document Solutions Inc., Osaka-shi, Osaka (JP)

(72) Inventor: Tatsuhiko Yoshii, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/222,797

(22) Filed: Jul. 28, 2016

(65) Prior Publication Data

US 2017/0060026 A1 Mar. 2, 2017

(30) Foreign Application Priority Data

Aug. 27, 2015 (JP) ..... 2015-167982

(51) Int. Cl.

| | |
|---|---|
| ***G03G 15/00*** | (2006.01) |
| ***G03G 15/08*** | (2006.01) |
| ***G03G 15/01*** | (2006.01) |

(52) U.S. Cl.

CPC ..... *G03G 15/0875* (2013.01); *G03G 15/0189* (2013.01); *G03G 15/0879* (2013.01); *G03G 2215/0132* (2013.01)

(58) Field of Classification Search

CPC ..... G03G 15/0886; G03G 15/0875; G03G 15/0865; G03G 15/0877; G03G 21/1676

See application file for complete search history.

(56) References Cited

U.S. PATENT DOCUMENTS

| | | | | |
|---|---|---|---|---|
| 6,438,345 | B1 | 8/2002 | Ban et al. | |
| 2014/0147174 | A1* | 5/2014 | Yoshii | G03G 15/0887 399/259 |

FOREIGN PATENT DOCUMENTS

| | | | |
|---|---|---|---|
| EP | 2523047 | A1 | 11/2012 |
| EP | 2738620 | A2 | 6/2014 |
| EP | 2911006 | A2 | 8/2015 |
| JP | 2000347493 | A | 12/2000 |

OTHER PUBLICATIONS

European Patent Office, Extended European Search Report Issues in Application No. 16177956.6, Feb. 16, 2017, Germany, 10 Pages.

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

In a toner case attachable to and detachable from a case storage portion of an image forming apparatus, a case main body is long in an attachment direction with respect to the case storage portion, and includes lower and upper housings defining lower and upper spaces among its inner space. Rims of upper-surface opening of the lower housing and lower-surface opening of the upper housing are joined together. A ceiling surface of the case storage portion is inclined diagonally upward from upper end of one side wall of the case storage portion toward the other opposite side wall in the width direction. The upper housing includes an inclined portion inclined corresponding to the inclined surface. When the case main body is attached to the case storage portion, the joint portion of the lower and upper housings has approximately the same height as the upper end of the side wall.

4 Claims, 15 Drawing Sheets

TONER CASE, AND IMAGE FORMING APPARATUS INCLUDING THE SAME

INCORPORATION BY REFERENCE

This application is based upon and claims the benefit of priority from the corresponding Japanese Patent Application No. 2015-167982 filed on Aug. 27, 2015, the entire contents of which are incorporated herein by reference.

BACKGROUND

The present disclosure relates to a toner case for storing toner, and an image forming apparatus including the toner case.

A developing device is installed in an image forming apparatus such as a copier, a printer or the like that forms an image on a sheet member by the electrophotography. Developer that includes toner is stored inside the developing device. The developing device develops, by the toner included in the developer, an electrostatic latent image formed on an image carrying member such as a photoconductor drum. The toner inside the developing device is decreased as the developing device performs the developing. As a result, the image forming apparatus includes a toner case in which the toner is contained such that the toner is supplied from the toner case to the developing device. In addition, the toner case is configured to be attachable to and detachable from the image forming apparatus, and when the toner in the toner case is used up, the empty toner case is replaced with a new toner case filled with toner.

SUMMARY

A toner case according to an aspect of the present disclosure is configured to be attachable to and detachable from a case storage portion of an image forming apparatus. The toner case includes a case main body. The case main body is formed to be long in an attachment direction with respect to the case storage portion, and includes a lower housing defining a lower space and an upper housing defining an upper space among an inner space of the case main body. A rim of an upper-surface opening of the lower housing and a rim of a lower-surface opening of the upper housing are joined together. A ceiling surface of the case storage portion includes an inclined surface inclined diagonally upward from an upper end of one side wall of the case storage portion toward the other side wall of the case storage portion, the one side wall and the other side wall being opposite to each other in a width direction of the case storage portion. The upper housing includes an inclined portion that is inclined corresponding to the inclined surface of the ceiling surface. In an attachment state where the case main body is attached to the case storage portion, a joint portion where the lower housing and the upper housing are joined together has approximately a same height as the upper end of the side wall.

A according to another aspect of the present disclosure includes a case storage portion, a plurality of toner cases, and an image forming portion. The case storage portion is configured to store a plurality of toner cases containing toner, in alignment in a predetermined direction. The plurality of toner cases are attached to the case storage portion, and are formed to be long in an attachment direction with respect to the case storage portion. The image forming portion forms an image on a sheet member by using the toner supplied from the plurality of toner cases. A ceiling surface of the case storage portion includes an inclined surface inclined diagonally upward from an upper end of one side wall of the case storage portion toward the other side wall of the case storage portion, the one side wall and the other side wall being opposite to each other in a width direction of the case storage portion. A first toner case, one of the plurality of toner cases that is disposed closest to the one side wall, includes a lower housing defining a lower space and an upper housing defining an upper space among an inner space of the first toner case. A rim of an upper-surface opening of the lower housing and a rim of a lower-surface opening of the upper housing are joined together. A second toner case that is adjacent to the first toner case, includes a housing main body storing toner and a lid that covers an upper-surface opening of the housing main body. A rim of the upper-surface opening of the housing main body and a rim of the lid are joined together. The upper housing includes an inclined portion that is inclined corresponding to the inclined surface of the ceiling surface. A first joint portion at which the lower housing and the upper housing of the first toner case are joined together, is lower in height than a second joint portion at which the housing main body and the lid of the second toner case are joined together.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It should be noted that the following embodiment is an example of a specific embodiment of the present disclosure and should not limit the technical scope of the present disclosure.

Figure 1:
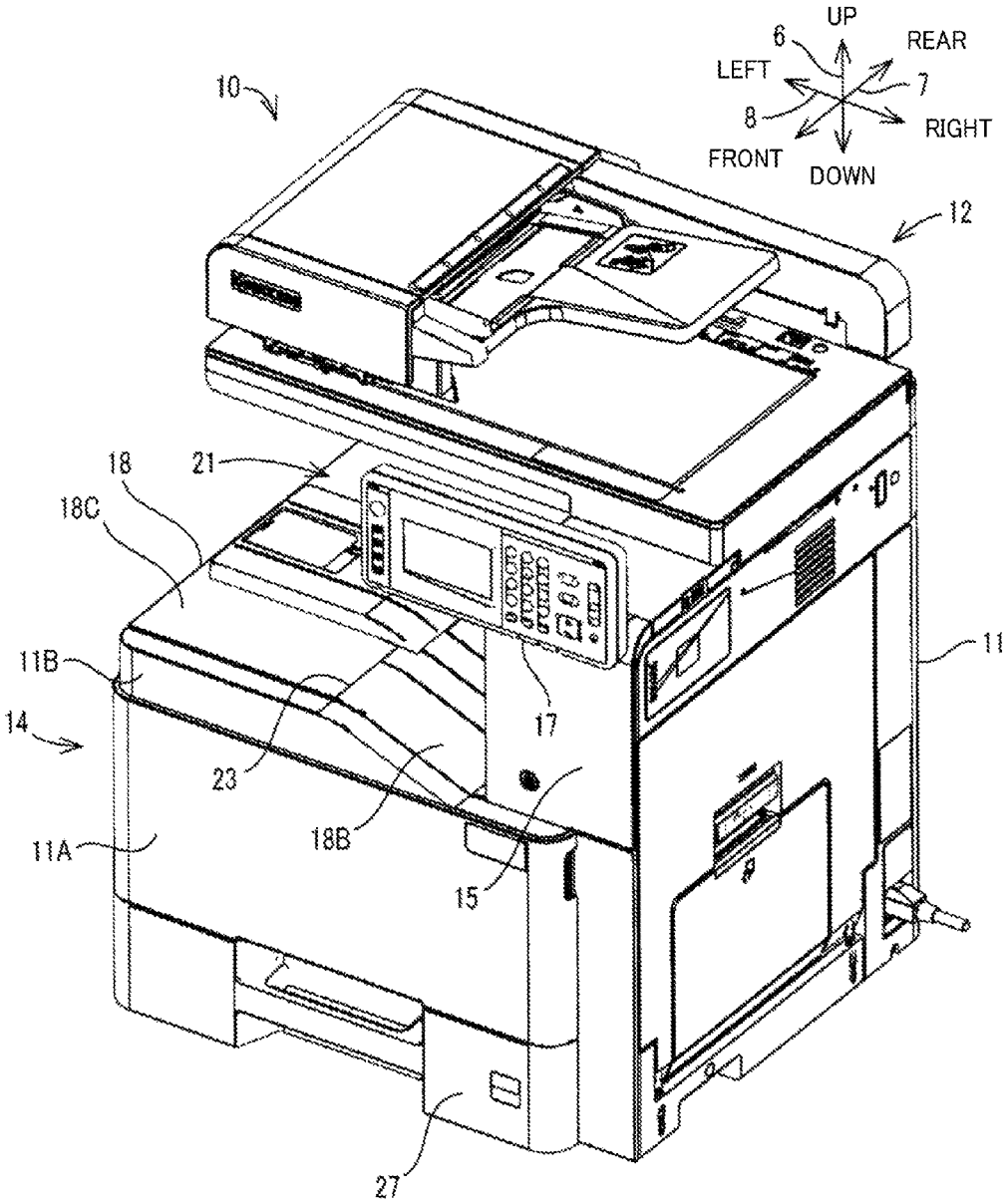
FIG. 1 is a perspective view of an image forming apparatus according to an embodiment of the present disclosure.

FIG. 1 is a diagram showing the configuration of an image forming apparatus 10 according to an embodiment of the present disclosure. For the sake of explanation in the following description, an up-down direction 6 is defined based on the state where an image forming apparatus 10 is installed to be usable (the state shown in FIG. 1). In addition, a front-rear direction 7 is defined on the supposition that the side on which an operation display portion 17 is provided in the above-mentioned installment state is the front side. Furthermore, a left-right direction 8 is defined based on the image forming apparatus 10 in the installment state viewed from the front side.

As shown in FIG. 1, the image forming apparatus 10 is a multifunction peripheral having a plurality of functions such as a print function, a copy function, a facsimile function, and a scan function. The image forming apparatus 10 is not limited to a multifunction peripheral, but may be any apparatus, such as a printer, a copier, or a facsimile apparatus, that has a print function.

The image forming apparatus 10 includes an image reading portion 12 and an image forming portion 14. The image reading portion 12 performs a process of reading an image from a document sheet, and is provided in the upper part of the image forming apparatus 10. The image forming portion 14 performs a process of forming a color image based on the electrophotography, and is provided in the lower part of the image forming apparatus 10. In addition, a sheet discharge portion 15 is provided on the right side of the image forming portion 14.

Above the image forming portion 14, there is provided a discharge space 21. The sheet discharge portion 15 is formed in such a way as to couple the image forming portion 14 and the image reading portion 12 vertically with the discharge space 21 formed therebetween. As shown in FIG. 1, the front side and the left side of the discharge space 21 are opened. In addition, the rear side of the discharge space 21 is not opened, but is closed by a rear panel or the like. Furthermore, the sheet discharge portion 15 is provided on the right side of the discharge space 21. In this way, the right side of the sheet discharge space 21 is closed by the sheet discharge portion 15.

The sheet discharge portion 15 discharges a sheet member with an image formed thereon to the discharge space 21. A left side surface of the sheet discharge portion 15 that faces the discharge space 21 has a sheet discharge port 15A. The sheet discharge port 15A is formed above an end portion 24 of a sheet tray 18 that is described below. The sheet member is discharged from the sheet discharge port 15A.

The image forming portion 14 includes a housing 11 as an apparatus main body. The components constituting the image forming portion 14 are arranged in the housing 11. The housing 11 includes an outer frame and an inner frame, wherein the outer frame covers the whole of the image forming portion 14, and the inner frame supports the components constituting the image forming portion 14. The housing 11, as a whole, has an approximately rectangular parallelepiped shape.

Figure 2:
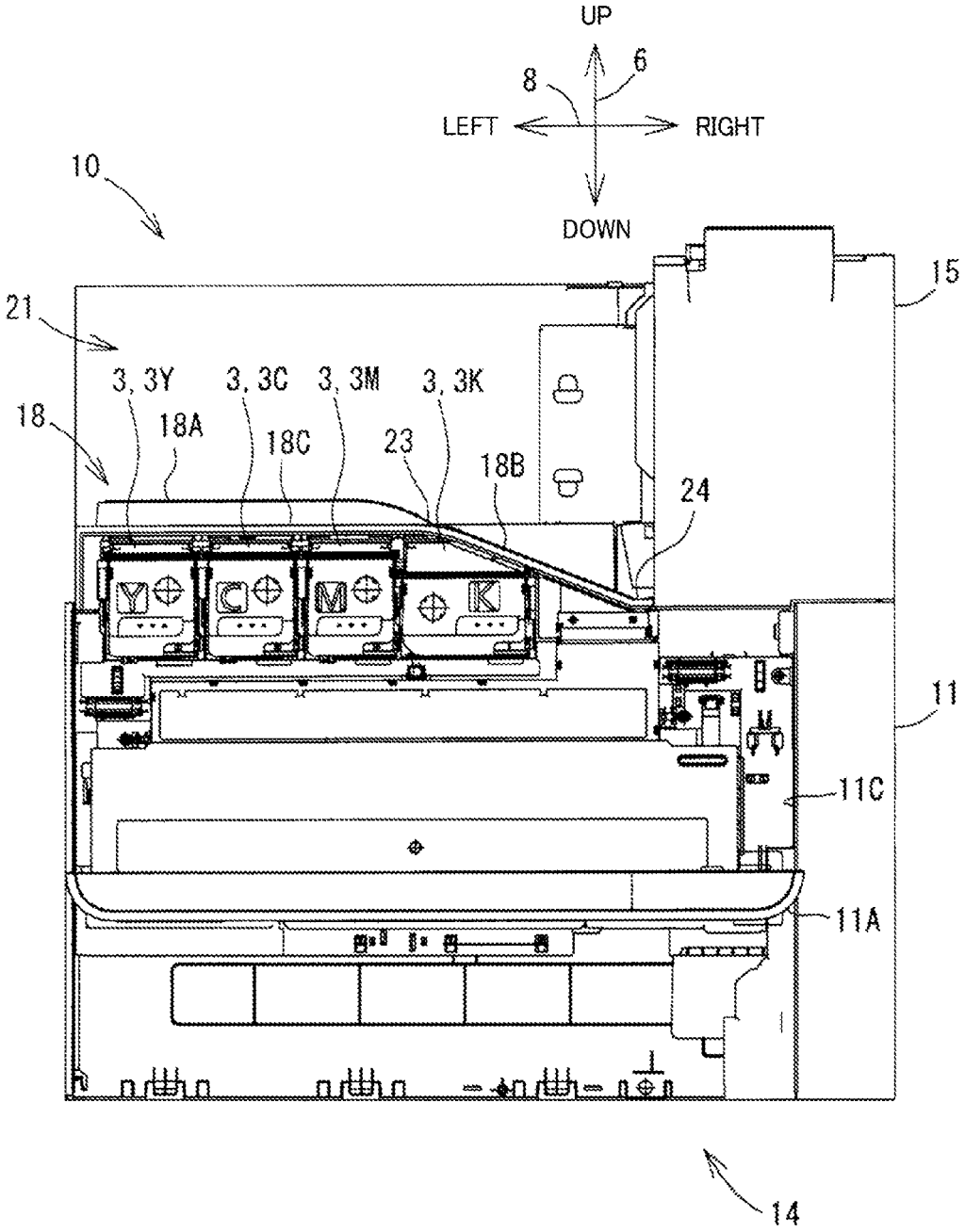
FIG. 2 is a front view of the image forming apparatus in a state where a front cover of a housing is opened.

The housing 11 includes a front cover 11A and a side cover 11B. The front cover 11A and the side cover 11B covers an opening 11C that is provided on the front side of the housing 11. The front cover 11A is pivoted around, as a fulcrum, near an upper end of a sheet cassette 27 between an attitude for opening the opening 11C of the housing 11 (see FIG. 2), and an attitude for closing the opening 11C (see FIG. 1). When the front cover 11A is opened, the inside of the image forming portion 14 is exposed (see FIG. 2). The side cover 11B is disposed above the front cover 11A. The side cover 11B is fixed to the housing 11 by a fixing tool such as a screw. With this configuration, the side cover 11B closes the upper part of the opening 11C that cannot be closed by the front cover 11A. FIG. 2 shows a state where the side cover 11B is removed and the front cover 11A is opened.

Figure 3:
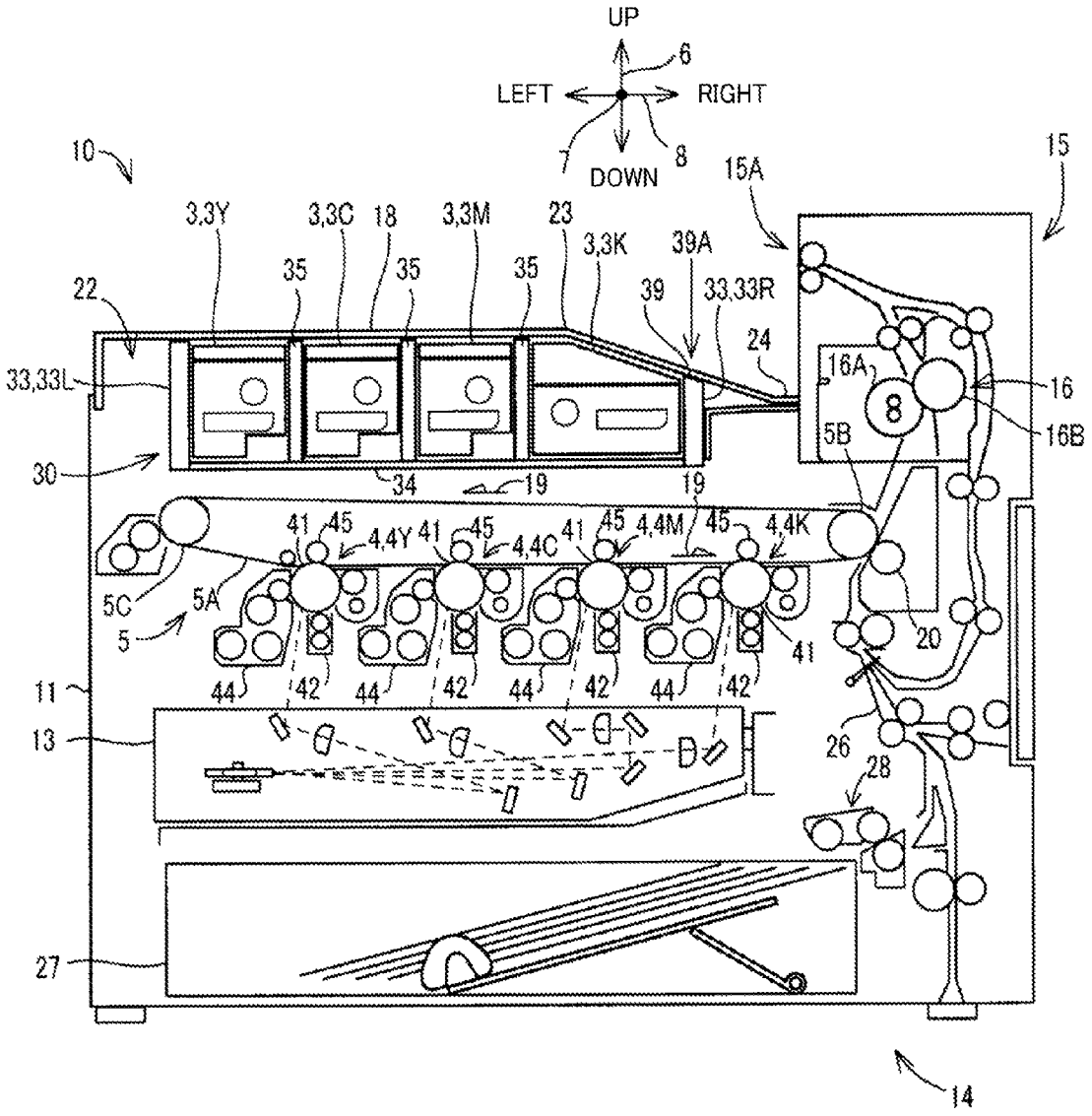
FIG. 3 is a diagram showing the internal configuration of an image forming portion included in the image forming apparatus.

FIG. 3 is a diagram showing the internal configuration of the image forming portion 14. In FIG. 3, the image reading portion 12 is omitted. The image forming portion 14 forms a color image on a sheet member such as a print sheet based on the so-called tandem system. As shown in FIG. 3, the image forming portion 14 includes a plurality of image forming units 4, an intermediate transfer unit 5, a laser scanning device 13, a secondary transfer roller 20, a fixing device 16, a sheet tray 18, a sheet cassette 27, a sheet feed unit 28, an operation display portion 17 (see FIG. 1), a conveyance path 26, a container attachment portion 30 (case storage portion), and a control portion (not shown).

The sheet feed unit 28 picks up, one by one, sheet members stacked in the sheet cassette 27, and feeds the sheet member toward the conveyance path 26.

The image forming units 4 (4C, 4M, 4Y, and 4K) are provided below the intermediate transfer unit 5. The plurality of image forming units 4 are arranged in alignment along the running direction (the direction indicated by the arrow 19) of a transfer belt 5A. In order from left to right of the transfer belt 5A, the image forming units 4Y for yellow color, 4C for cyan color, 4M for magenta color, and 4K for black color are disposed in the stated order. Each of the image forming units 4 includes a photoconductor drum 41, a charging device 42, a developing device 44, and a primary transfer roller 45. The image forming unit 4Y forms a toner image on the surface of the photoconductor drum 41 by using yellow toner. The image forming units 4C, 4M and 4K form toner images on the surfaces of the photoconductor drums 41 by using cyan toner, magenta toner, and black toner, respectively. The developing devices 44 respectively perform developing processes for developing the toner images on the photoconductor drums 41.

As shown in FIG. 3, the intermediate transfer unit 5 includes a transfer belt 5A, a driving roller 5B and a driven roller 5C. The transfer belt 5A is a belt member on which toner images of respective colors formed on the photoconductor drums 41 of the image forming units 4 are transferred. The transfer belt 5A is disposed above the photoconductor drums 41. The transfer belt 5A is an endless annular belt. The transfer belt 5A is supported by the driving roller 5B and the driven roller 5C that are separated from each other in the left-right direction 8, so as to be able to run around them. The transfer belt 5A is suspended between and supported by the driving roller 5B and the driven roller 5C. When the transfer belt 5A passes through between the photoconductor drums 41 and the primary transfer rollers 45, the toner images are transferred in sequence from the photoconductor drums 41 onto a surface of the transfer belt 5A so as to be overlaid with each other.

Each of the laser scanning devices 13 irradiates the surface of the photoconductor drum 41 of the image forming unit 4 with a laser beam based on input image data of a corresponding color. With this operation, electrostatic latent images are formed on the respective photoconductor drums 41.

The secondary transfer roller 20 is disposed to face the driving roller 5B across the conveyance path 26 that extends vertically. By a transfer potential applied to the secondary transfer roller 20, the toner image on the transfer belt 5A is transferred to the sheet member. The sheet member with the toner image transferred thereon is conveyed to the fixing device 16.

The fixing device 16 fixes the toner image transferred on the sheet member, to the sheet member by heating it. The fixing device 16 includes a heating roller 16A and a pressure roller 16B. In the fixing device 16, the sheet member is conveyed while being nipped by the heating roller 16A and the pressure roller 16B. During this conveyance, heat is transmitted from the heating roller 16A to the toner image transferred on the sheet member, and the toner image is heated. This allows the toner image to be fixed to the sheet member. Subsequently, the sheet member is discharged to the sheet tray 18 by the sheet discharge portion 15.

As shown in FIG. 3, the sheet tray 18 is provided in the discharge space 21. The sheet tray 18 holds sheet members that each have been passed through the fixing device 16 and discharged to outside from the sheet discharge port 15A. The sheet tray 18 also serves as an outer frame that constitutes an upper surface of the image forming portion 14. Sheet members discharged to the sheet tray 18 are stacked thereon. A plurality of ribs 18A (see FIG. 2) extending in the left-right direction 8 are formed on the upper surface of the sheet tray 18 (sheet stacking surface). The sheet members discharged to the sheet tray 18 are supported by the upper ends of the ribs 18A.

The sheet tray 18 is a plate-like member made of synthetic resin or the like, and extends in the left-right direction 8. Specifically, the sheet tray 18 extends from the left side surface of the sheet discharge portion 15 to the left side surface of the housing 11. The sheet tray 18 includes an inclined surface 18B and a horizontal surface 18C. In the sheet tray 18, a portion on one side (specifically, the right side) in the left-right direction 8 that matches the width direction of the container attachment portion 30 that is described below, is the inclined surface 18B. That is, the right side portion of the sheet tray 18 is inclined diagonally downward. In other words, the inclined surface 18B extends diagonally upward from a right side end portion 24 of the sheet tray 18 toward the left side, passes a support point 39A, namely an upper end 39 of a side wall 33R that is described below, and is further inclined diagonally upward at the same inclination angle from the support point 39A of the upper end 39.

On the other hand, in the sheet tray 18, a portion on the other side (specifically, the left side) opposite to the inclined surface 18B in the left-right direction 8 is the horizontal surface 18C. The inclined surface 18B is inclined diagonally downward toward the sheet discharge portion 15 side. The horizontal surface 18C horizontally extends leftward from a left side end 23 of the inclined surface 18B. With this configuration, the front-end portions of the sheet members discharged to the sheet tray 18 are held by the horizontal surface 18C, and the rear-end portions are held by the inclined surface 18B.

As shown in FIG. 2 and FIG. 3, a storage space 22 is formed between the intermediate transfer unit 5 and the sheet tray 18. The container attachment portion 30 is provided in the storage space 22. That is, the sheet tray 18 is disposed above the container attachment portion 30, and the intermediate transfer unit 5 is disposed below the container attachment portion 30. As described above, the sheet tray 18 includes the inclined surface 18B and the horizontal surface 18C. As a result, the storage space 22 becomes gradually narrower from the end 23 that is a boundary between the horizontal surface 18C and the inclined surface 18B, toward the sheet discharge portion 15 side (right side).

Meanwhile, in the recent years, compactification of the image forming apparatus 10 has been demanded strongly. In particular, in the color printer, since it includes a plurality of toner containers 3, it has been demanded that the image forming apparatus 10 is made compact without changing the toner capacity of each toner container. In the present embodiment, the container attachment portion 30 and the toner containers 3 are configured so that wasteful spaces around attachment position of the toner containers 3 can be reduced. In the following, the configurations of the container attachment portion 30 and the toner containers 3 are explained.

[Configuration of Container Attachment Portion 30]

Figure 4:
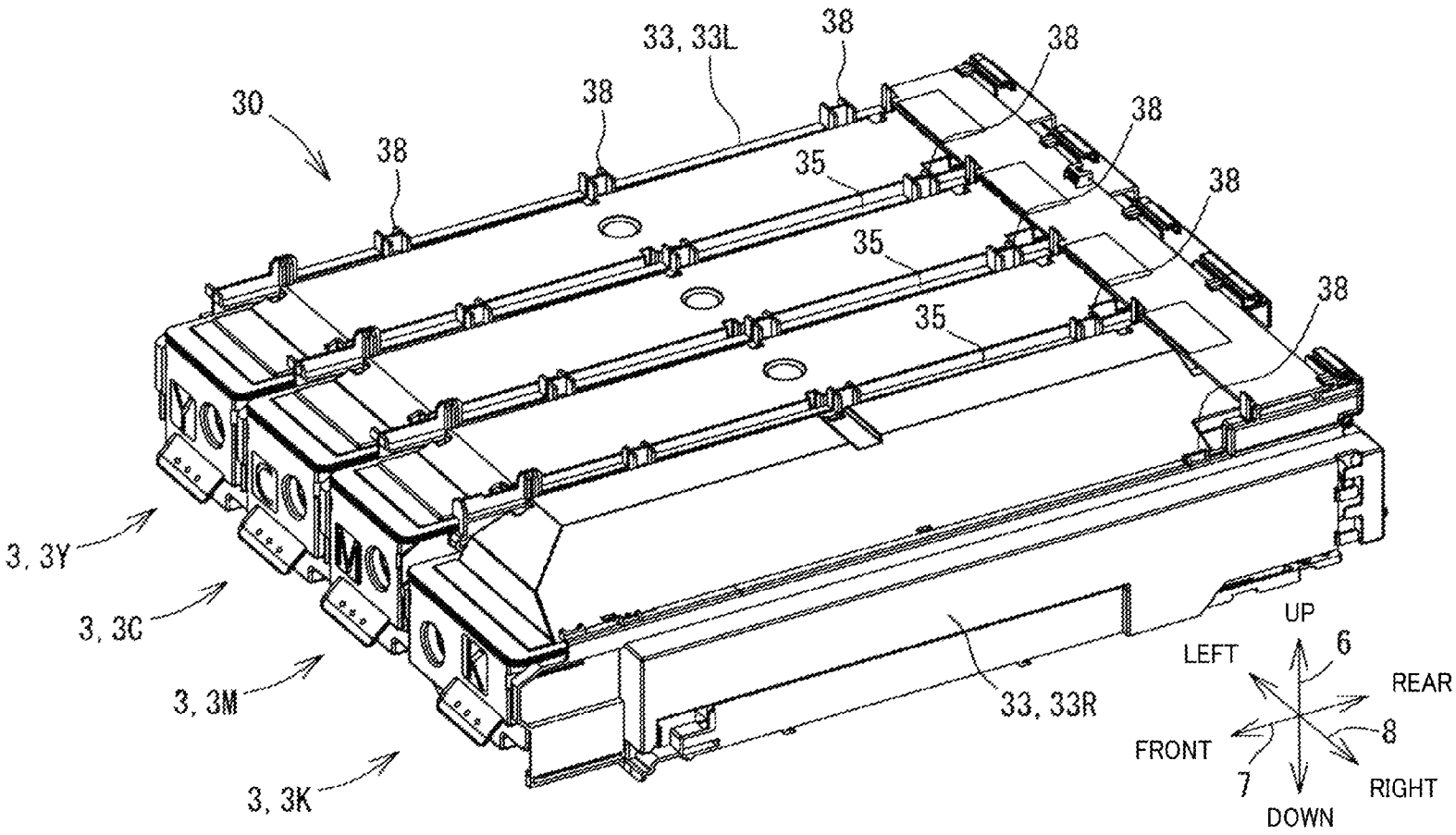
FIG. 4 is a perspective view of a container attachment portion viewed from front diagonally above.
Figure 5:
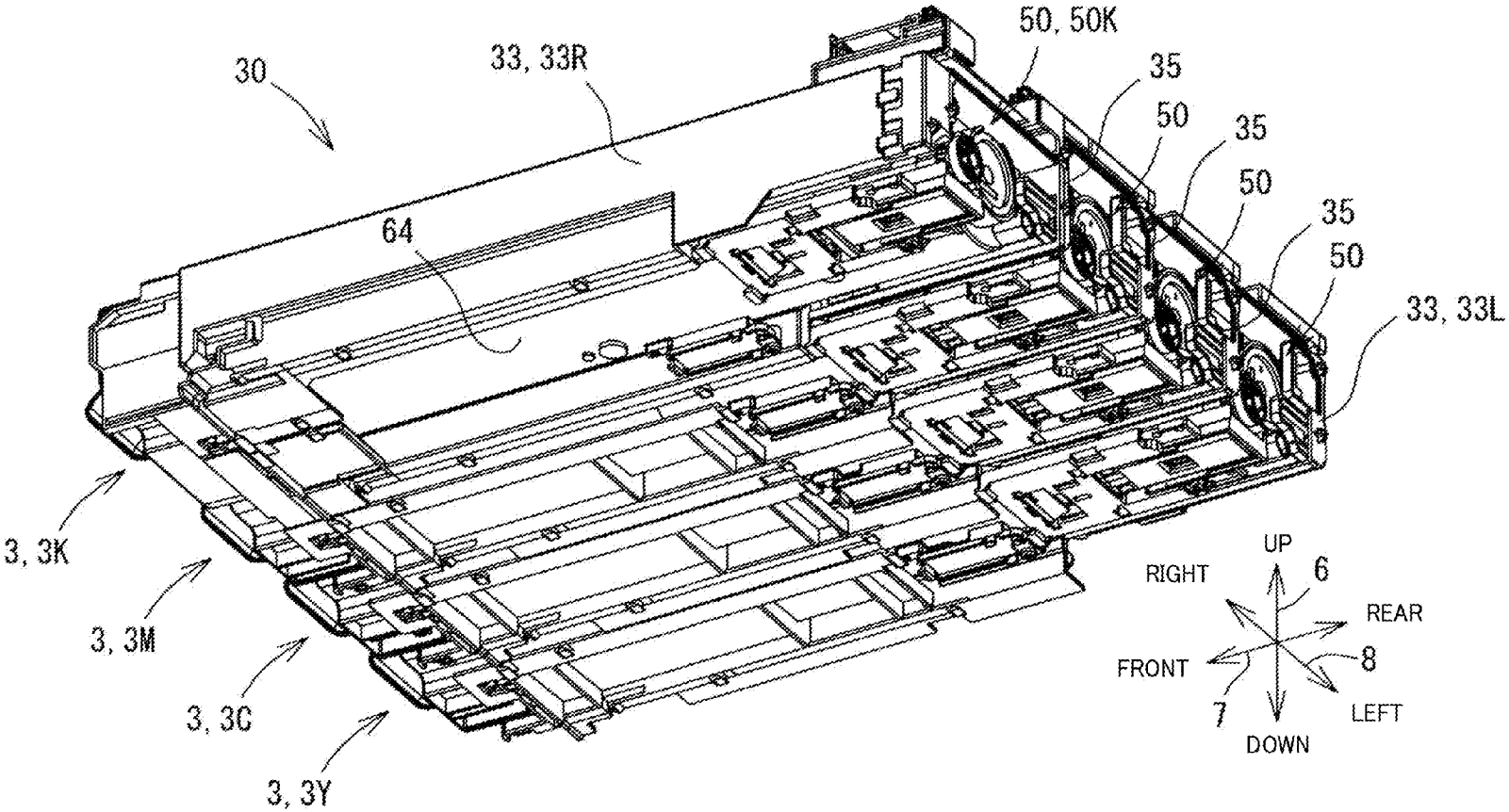
FIG. 5 is a perspective view of the container attachment portion viewed from rear diagonally below.
Figure 6:
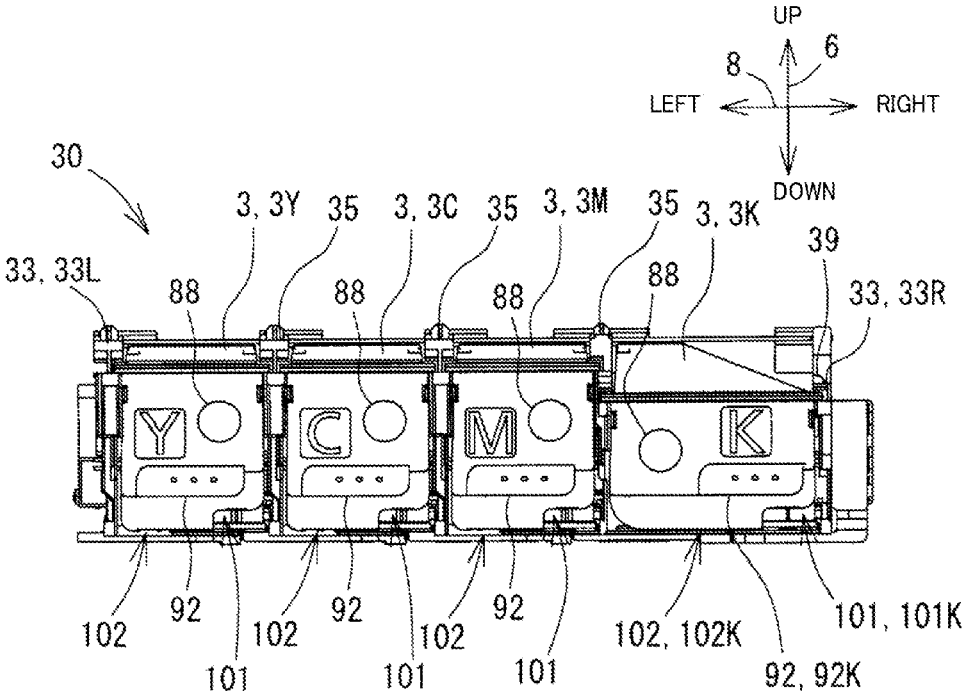
FIG. 6 is a front view of the container attachment portion.
Figure 7:
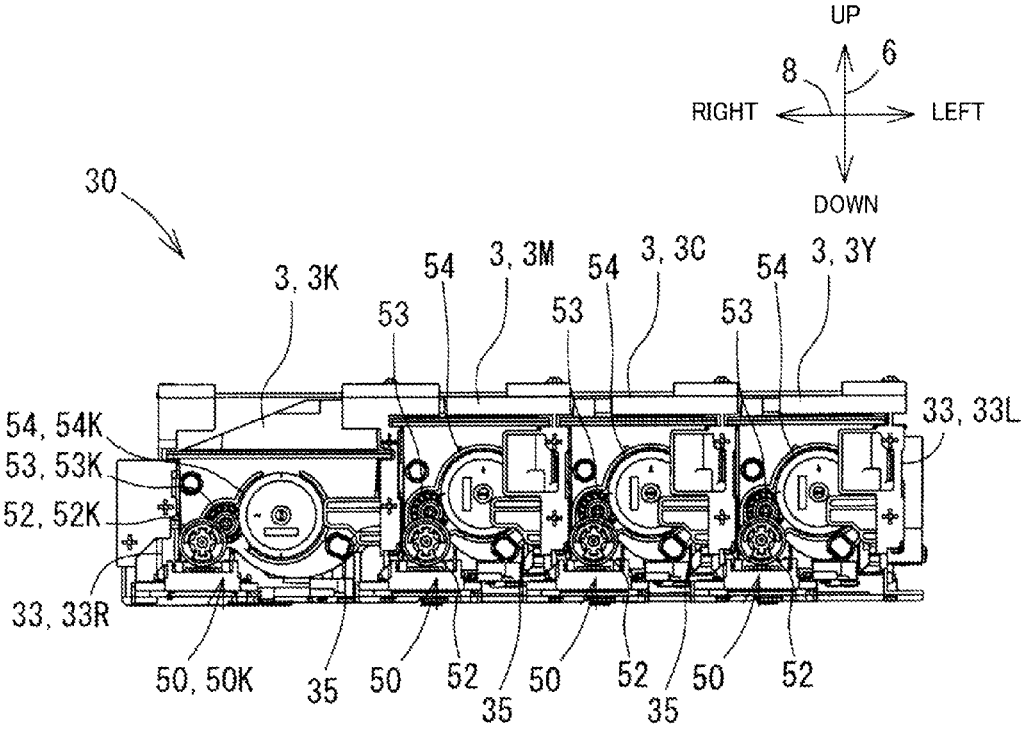
FIG. 7 is a rear view of the container attachment portion.
Figure 8:
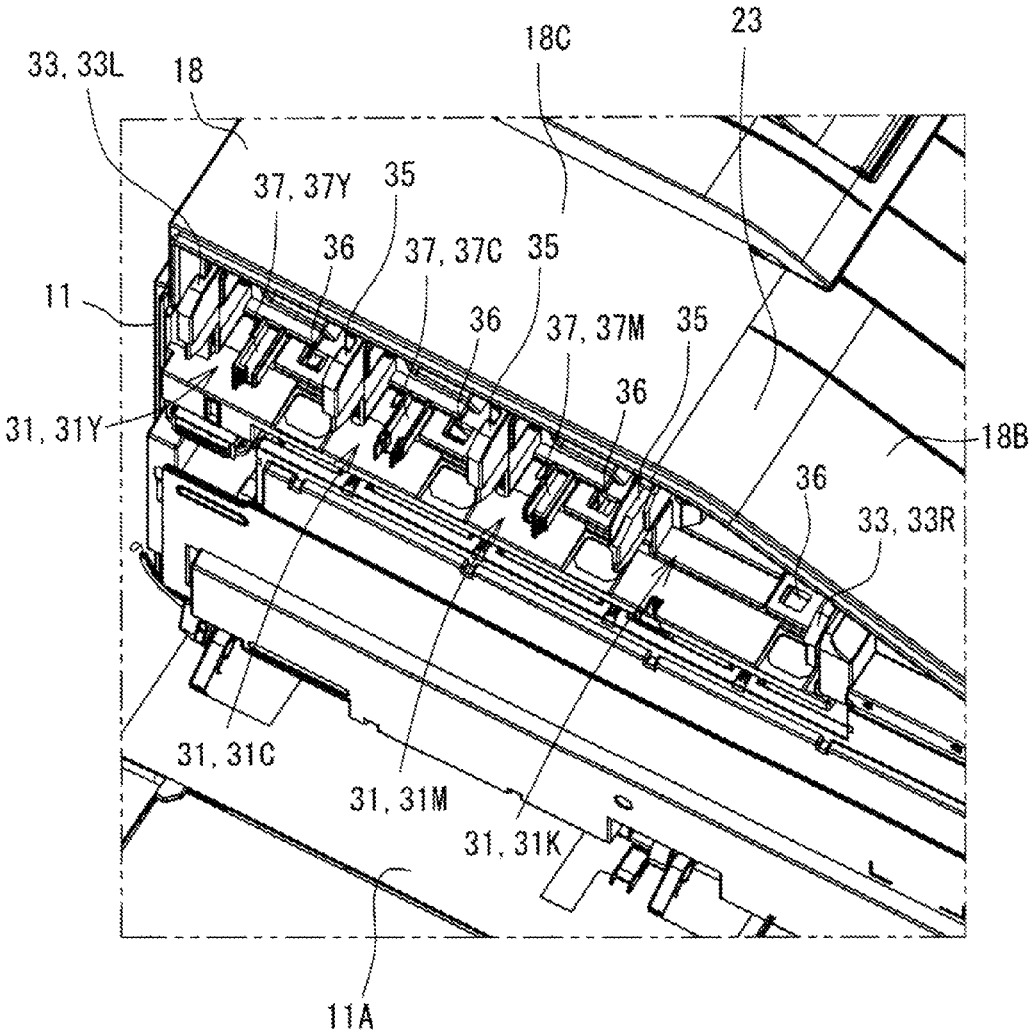
FIG. 8 is a partial perspective view showing the configuration of a front side portion of the container attachment portion.

FIG. 4 to FIG. 8 are diagrams showing the configuration of the container attachment portion 30. FIG. 4 is a perspective view of the container attachment portion 30 viewed from front diagonally above. FIG. 5 is a perspective view of the container attachment portion 30 viewed from rear diagonally below. FIG. 6 is a front view of the container attachment portion 30. FIG. 7 is a rear view of the container attachment portion 30. FIG. 8 is a partial perspective view showing the configuration of a front side portion of the container attachment portion 30. FIG. 4 to FIG. 7 each show an attached state of the toner containers 3. The container attachment portion 30 is fixed to the inner frame of the housing 11. The container attachment portion 30 holds the plurality of toner containers 3 (toner cases) in an attachable/detachable manner. That is, the toner containers 3 are attached to the container attachment portion 30 of the image forming apparatus 10 in the attachable/detachable manner.

As shown in FIG. 8, the container attachment portion 30 includes four storage chambers 31 (31Y, 31C, 31M and 31K) for storing the toner containers 3 of respective colors. The container attachment portion 30 supports the toner containers 3 in the corresponding storage chambers 31 in such a manner that the toner containers 3 can be slid in the front-rear direction 7. The four storage chambers 31 respectively correspond to the toner containers 3, and are arranged in alignment along the left-right direction 8. Specifically, the container attachment portion 30 includes two side walls 33 (33L and 33R) at opposite ends in the left-right direction 8, a bottom plate 34 constituting a bottom surface, and three partition walls 35 that partition the space of the container attachment portion 30 in the left-right direction 8. Each partition wall 35 stands upright from the bottom plate 34 of the container attachment portion 30. The storage chambers 31 are spaces surrounded by the two side walls 33, the partition walls 35, and the bottom plate 34.

In the present embodiment, a storage chamber 31K is disposed at the rightmost position to store a toner container 3K which contains black toner. On the left of the storage chamber 31K, storage chambers 31M, 31C and 31Y are provided in alignment in the stated order. The storage chamber 31M stores a toner container 3M containing magenta toner and is disposed adjacent to the storage chamber 31K. The storage chamber 31C stores a toner container 3C containing cyan toner. The storage chamber 31Y disposed at the leftmost position stores a toner container 3Y containing yellow toner. Since the storage chambers 31 are disposed in this way, when the toner container 3K is stored in the storage chamber 31K and the toner container 3M is stored in the storage chamber 31M, the toner container 3K and the toner container 3M are adjacent to each other when they are attached to the container attachment portion 30. It is noted that the toner container 3K is an example of the first toner case of the present disclosure, and the toner container 3M is an example of the second toner case of the present disclosure.

An engaging hole 36 is formed in the bottom surface of each storage chamber 31 (see FIG. 8), wherein the engaging hole 36 is an example of the engaging portion. In the engaging hole 36, a lock claw 106 provided on each toner container 3 (see FIG. 12) is inserted, wherein the lock claw 106 is described below. When a toner container 3 is stored in a storage chamber 31 and inserted to a predetermined attachment position, the lock claw 106 reaches and enters the engaging hole 36. This allows the toner container 3 to be locked in the drawing direction (front direction).

In addition, as shown in FIG. 8, fitting portions 37 (37Y, 37C and 37M) are provided on the bottom surfaces of the storage chambers 31Y, 31C and 31M, such that the toner containers 3Y, 3C and 3M are selectively attached to the storage chambers 31Y, 31C and 31M, respectively. The storage chamber 31Y is provided with a fitting portion 37Y that allows attachment of only the toner container 3Y. The storage chamber 31C is provided with a fitting portion 37C that allows attachment of only the toner container 3C. The storage chamber 31M is provided with a fitting portion 37M that allows attachment of only the toner container 3M. Each fitting portion 37 is a groove in which a rib 105 can be inserted, wherein the rib 105 is provided on a lower surface of the toner container 3 as a compatible member. The fitting portion 37 allows the toner container 3 to be attached to the storage chamber 31 when there is no shift between the rib 105 and the fitting portion 37. On the other hand, when there is a shift between the rib 105 and the fitting portion 37, the fitting portion 37 does not engage with the rib 105, and the toner container 3 is prohibited from being attached to the storage chamber 31.

An upper side of each storage chamber 31 is opened. A sheet tray 18 is provided above the container attachment portion 30 in such a way as to cover the openings. The sheet tray 18 is supported by a plurality of projections 38 (see FIG. 4) that are provided on the upper end portions of the side walls 33 and the partition walls 35. That is, the ceiling surface of the container attachment portion 30 is constituted by a lower surface of the sheet tray 18.

The storage chamber 31K is disposed below the inclined surface 18B of the sheet tray 18. In other words, the upper opening portion of the storage chamber 31K is covered with the inclined surface 18B. On the other hand, the upper opening portions of the other storage chambers 31Y, 31C and 31M are covered with the horizontal surface 18C. As a result, the storage chamber 31K is smaller than each of the other storage chambers 31Y, 31C and 31M in size in the height direction.

In addition, the container attachment portion 30 is formed in a shape that corresponds to the storage space 22 so as to be installed in the storage space 22. Specifically, the right side wall 33R is formed to be lower than the left side wall 33L and the partition walls 35. In addition, the left side wall 33L and the partition walls 35 have the same height. In other words, a height position of the upper end 39 of the side wall 33R is lower than the height positions of the side wall 33L and the partition walls 35 by a difference in the height direction between the horizontal surface 18C and the inclined surface 18B. This enables the container attachment portion 30 to be disposed close to the right side in the storage space 22, thereby reducing a waste space between the container attachment portion 30 and the sheet discharge portion 15. As a result, the image forming apparatus 10 can be made compact in the left-right direction 8.

In the container attachment portion 30, intervals between the side walls 33 and the partition walls 35, namely, the widths of the respective storage chambers 31 are sized to correspond to the widths of the respective toner containers 3. In the present embodiment, the toner container 3K stored in the storage chamber 31K contains black toner that is consumed most and thus has a larger capacity than the other toner containers 3 (3Y, 3C and 3M). On the other hand, the storage chamber 31K is smaller than the other storage chambers 31 in size in the height direction due to the inclined surface 18B. As a result, the toner container 3K has a different shape from the other toner containers 3 (3Y, 3C and 3M). Although details are described below, the black toner container 3K is wider than the other toner containers 3, and the upper part of the toner container 3K is formed to be inclined along the inclined surface 18B.

[Configuration of Toner Container 3M]

Figure 12:
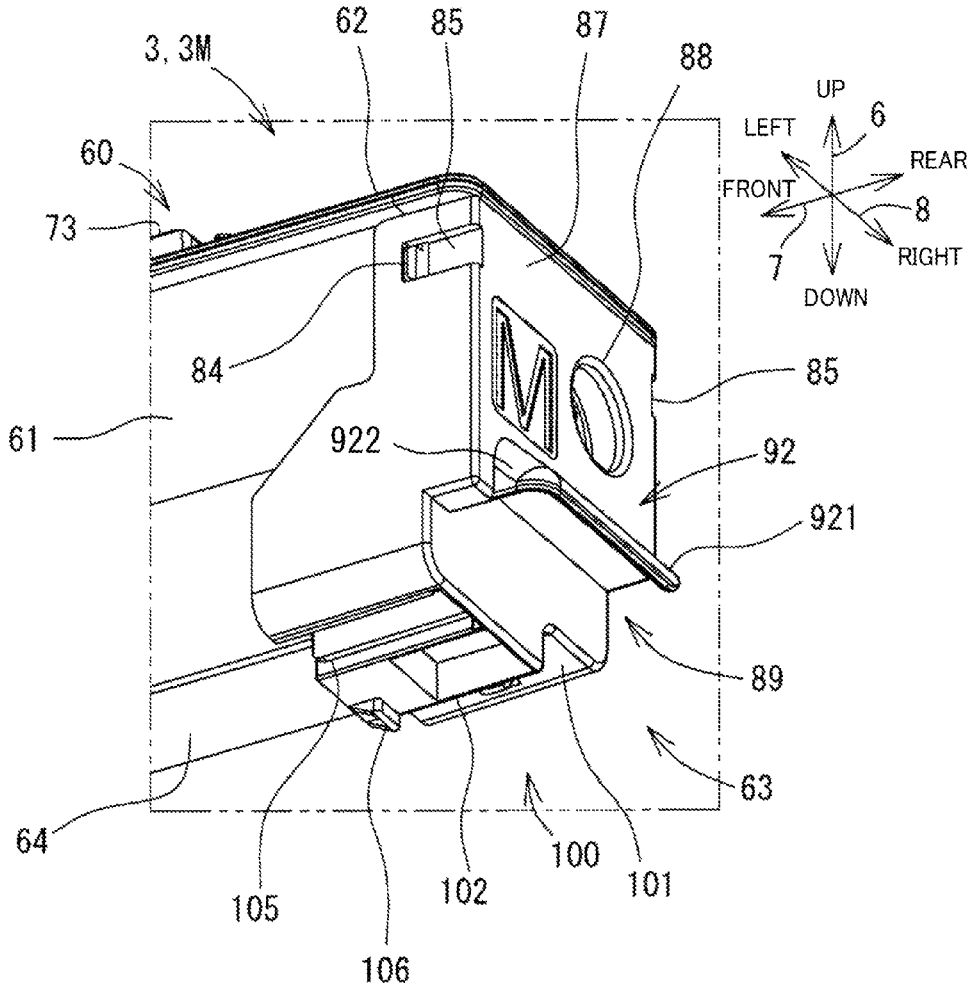
FIG. 12 is a perspective view of the front portion of the toner container for magenta color.
Figure 13B:
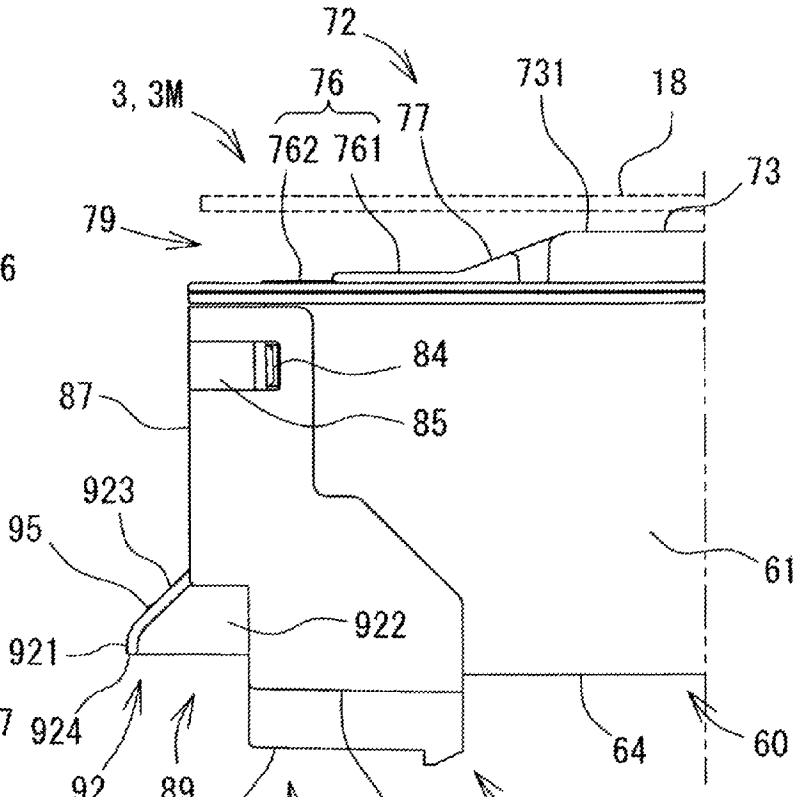
FIG. 13B is a side view of the toner container for magenta color.
Figure 13A:
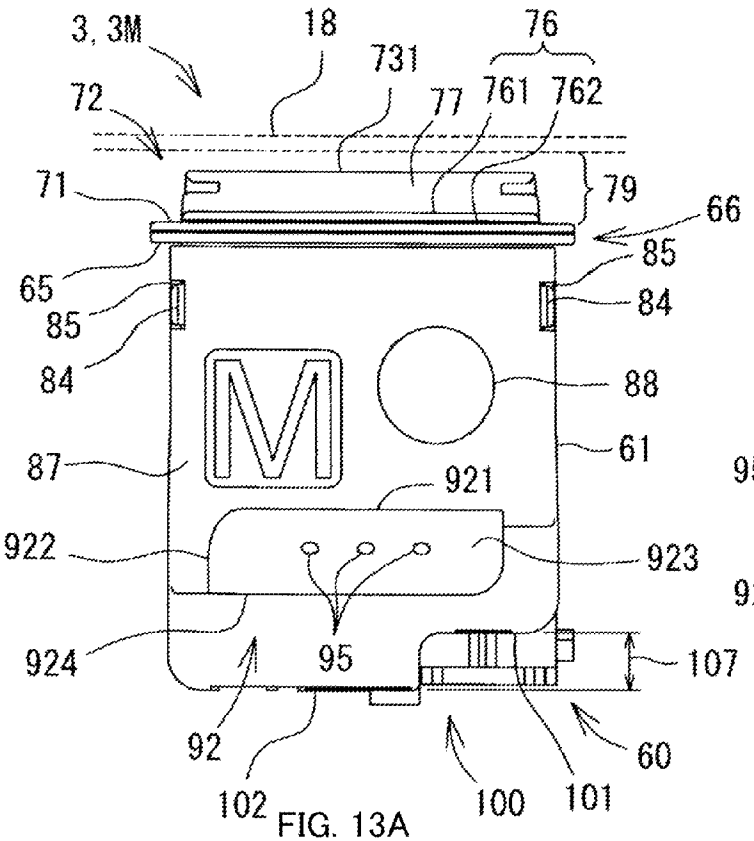
FIG. 13A is a front view of the toner container for magenta color.
Figure 14:
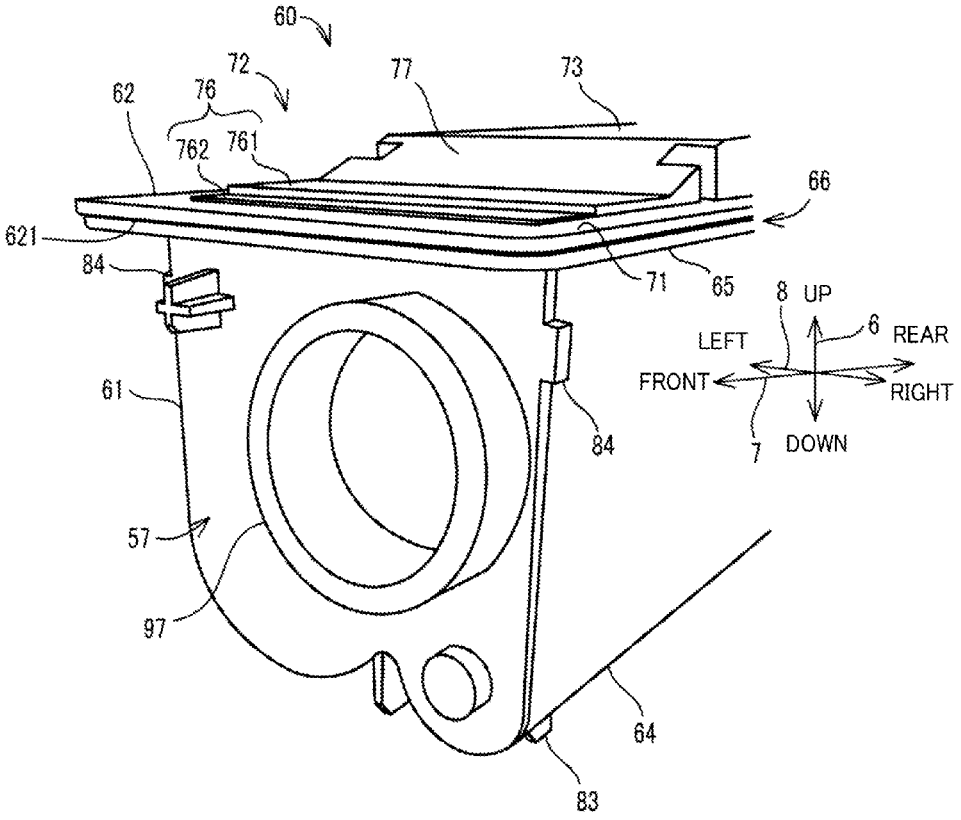
FIG. 14 is a perspective view showing a state where a cover member has been removed from the toner container for magenta color.

The following describes the configuration of the toner container 3M containing magenta toner in detail with reference to FIG. 9 to FIG. 14. FIG. 9 to FIG. 13B show the toner container 3M. FIG. 14 shows a state where a cover member 63 is removed from the toner container 3M. The toner containers 3Y and 3C for colors yellow and cyan have the same configuration as the toner container 3M. Thus the following describes the configuration of the toner container 3M as a representative of the toner containers 3Y, 3C and 3M for respective colors. It is noted that in the drawings, on the basis of an attitude of the toner container 3M when it is attached to the container attachment portion 30 (attachment attitude), the vertical direction is represented as the up-down direction 6, the insertion/drawing direction with respect to the container attachment portion 30 is represented as the front-rear direction 7, and the horizontal direction when viewed from the front in the attachment attitude is represented as the left-right direction 8.

The toner container 3M supplies toner to the developing device 44 of the image forming unit 4M. The toner container 3M is attachable/detachable with respect to the container attachment portion 30 provided in the housing 11, and is supported such that it can be slid in the front-rear direction 7 when attached to and detached from the container attachment portion 30.

Figure 9:
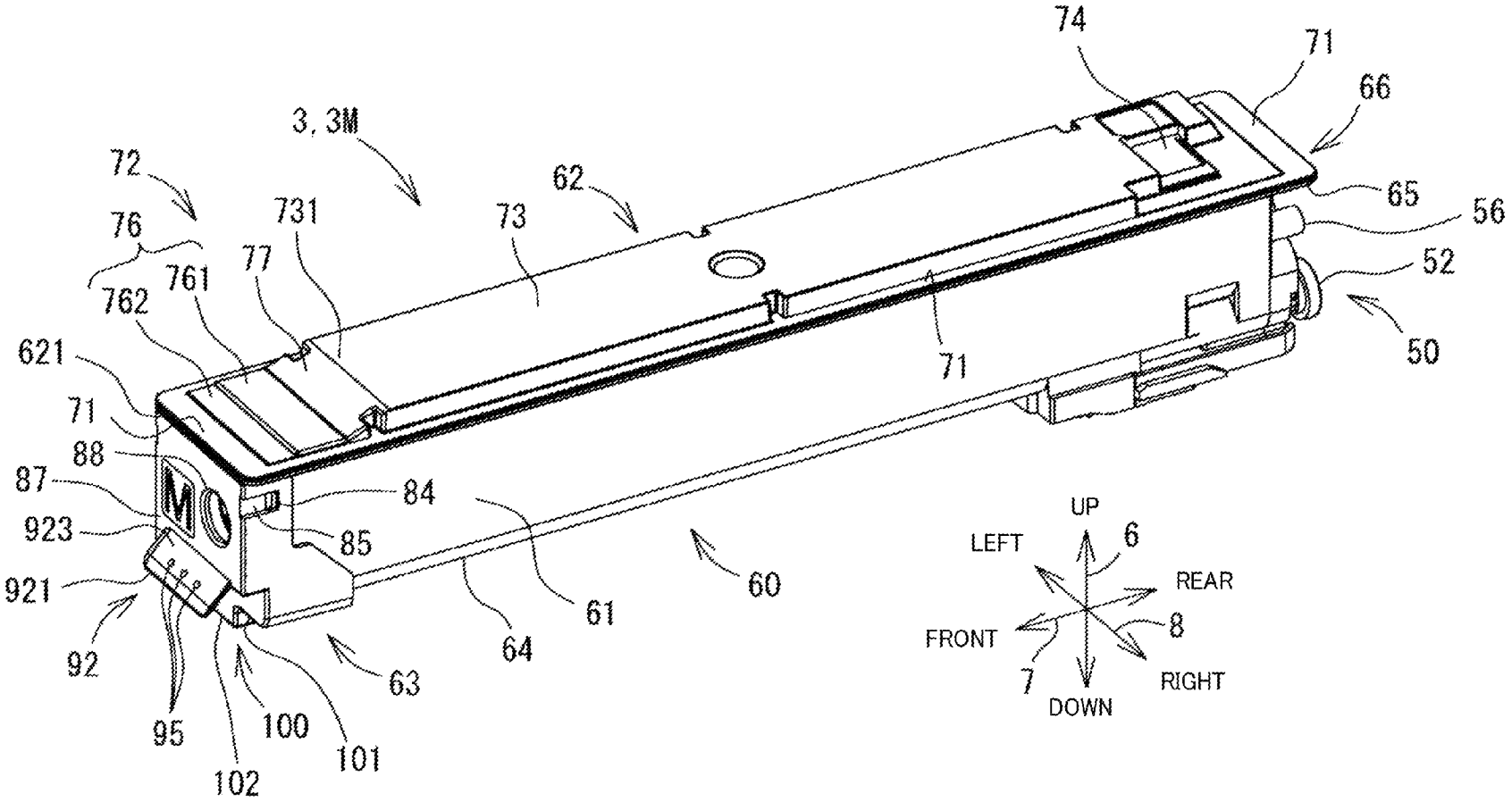
FIG. 9 is a perspective view of a toner container for magenta color.

As shown in FIG. 9, the toner container 3M is formed to be long in the front-rear direction 7. The toner container 3M includes a case main body 60 and a cover member 63. The case main body 60 is formed to be long in the front-rear direction 7, and is composed of a housing 61 (housing main body) and a lid 62. The housing 61, the lid 62, and the cover member 63 are synthetic resin products made of synthetic resin such as ABS resin or PET resin.

The housing 61 is for storing toner and is formed in the shape of a box that is long in the front-rear direction 7. The housing 61 has a large rectangular opening portion (upper-surface opening) at the top, and the opening portion is closed by the lid 62. The housing 61 stores toner that is used in the developing process by the developing device 44. A flange 65 is formed at the rim of the opening of the housing 61. The flange 65 is formed at the whole rim of the opening. The flange 65 is a portion that is joined with a rim portion 71 of the lid 62. The flange 65 and the rim portion 71 are, in the state where they are put together, welded and joined by an impulse welding machine or the like. Hereinafter, a joint portion where the flange 65 and the rim portion 71 are joined together is referred to as a second joint portion 66.

The lid 62 is formed in a shape that corresponds to the upper surface of the housing 61, and is formed in the shape of a rectangle that is long in the front-rear direction 7. The lid 62 is configured to cover the opening portion of the housing 61, and is formed in a flat shape of a small thickness. The lid 62 includes a rim portion 71 and an upper-surface stage portion 73 (high stage portion), wherein the rim portion 71 abuts on the flange 65 of the housing 61, and the upper-surface stage portion 73 is slightly swollen from the rim portion 71.

The upper-surface stage portion 73 that is an upper surface of the lid 62, extends along the front-rear direction 7. A recessed portion 74 is formed in the rear side of the upper-surface stage portion 73. An identification sheet or a chip memory is attached to the recessed portion 74, wherein the identification sheet is read by a control portion of the image forming apparatus 10 for identification. On the front side of the upper surface of the lid 62, a step portion 72 including a front end portion 731 of the upper-surface stage portion 73 is formed. The step portion 72 is formed on the front end of the lid 62. A lower stage portion 76 is formed in front of the front end portion 731 of the upper-surface stage portion 73, wherein the lower stage portion 76 is lower than the upper-surface stage portion 73. The step portion 72 is composed of the front end portion 731 of the upper-surface stage portion 73 and the lower stage portion 76 that are formed on the upper surface of the lid 62 in alignment in the front-rear direction 7. The lower stage portion 76 is lower than the front end portion 731 in height position. In other words, the lower stage portion 76 is lower than the upper-surface stage portion 73.

In the present embodiment, the lower stage portion 76 is formed in front of the front end portion 731, extending from the front end portion 731 to a front end 621 of the lid 62. In addition, the lower stage portion 76 has a flat plane (flat surface) that extends from the front end portion 731 to the end 621.

As shown in FIG. 2 and FIG. 3, in the attachment state where the toner container 3M is attached to the container attachment portion 30, there is a small gap between the upper-surface stage portion 73 of the toner container 3M and the back surface of the sheet tray 18. Accordingly, with the provision of the lower stage portion 76 on the front end of the lid 62, a gap 79 is formed (see FIG. 13A and FIG. 13B) in which a finger of the user can be inserted.

Since the lower stage portion 76 is formed on the upper surface of the lid 62, when attaching the toner container 3M to the container attachment portion 30, the user can insert the toner container 3M to the depth of the storage chamber 31M while putting his/her finger on the lower stage portion 76. In addition, when drawing the toner container 3M from the container attachment portion 30, the user can insert his/her finger into the gap 79 that is between the lower stage portion 76 and the sheet tray 18 (see FIG. 13A and FIG. 13B). As a result, the user can easily grip the toner container 3M in the attachment state while putting his/her finger on the lower stage portion 76.

In particular, as described below, the cover member 63 has a handle 92. This enables the user to, for example, insert the forefinger of his/her right hand under the handle 92 to support the handle 92 from under, and put another finger (for example, the thumb) on the lower stage portion 76 to press it down. In this way, the user can grip the front end of the toner container 3M in a reliable manner.

In addition, an inclined surface 77 is formed on a portion that extends from the upper-surface stage portion 73 to the lower stage portion 76. With this configuration, when the user inserts his/her finger into the gap 79 (see FIG. 13A and FIG. 13B) to draw the toner container 3M, the ball of the finger abuts on the inclined surface 77. At this time, the ball of the finger fit on the lower stage portion 76 and the inclined surface 77 in its entirety. This enables the user to press the upper surface of the lid 62 by the ball of the finger with its entirety. In this way, the user can grip the toner container 3M stably in a reliable manner.

In addition, as shown in FIG. 9, the lower stage portion 76 includes a rear-side stage portion 761 and a front-side stage portion 762 (small stage portion). The upper surfaces of the stage portions 761 and 762 are flat planes (flat surfaces). The stage portion 762 is lower than the stage portion 761. That is, in the lower stage portion 76, the position of the stage portion 762 in the height direction is lower than the position of the stage portion 761 in the height direction. The stage portion 762 is formed in a region that extends, to the rim portion 71, from a position that is slightly closer to the front side than the intermediate position of the lower stage portion 76 in the front-rear direction 7. The step between the stage portion 761 and the stage portion 762 and the step between the stage portion 762 and the rim portion 71 both have small heights. In the present embodiment, each of these steps is smaller than the step between the lower stage portion 76 and the upper-surface stage portion 73.

The step between the stage portion 761 and the stage portion 762 and the step between the stage portion 762 and the rim portion 71 are each less than one millimeter in height. With the provision of the lower stage portion 76 as such, when the user inserts his/her finger into the gap 79 (see FIG. 13A and FIG. 13B) to draw the toner container 3M, the ball of the finger sequentially abuts on the rim portion 71, the stage portion 762, the stage portion 761, the inclined surface 77, and the upper-surface stage portion 73. That is, the user can sequentially feel the steps by the ball of the finger. This enables the user to sensuously recognize the depth of the inserted finger by sensing the plurality of steps.

Figure 10:
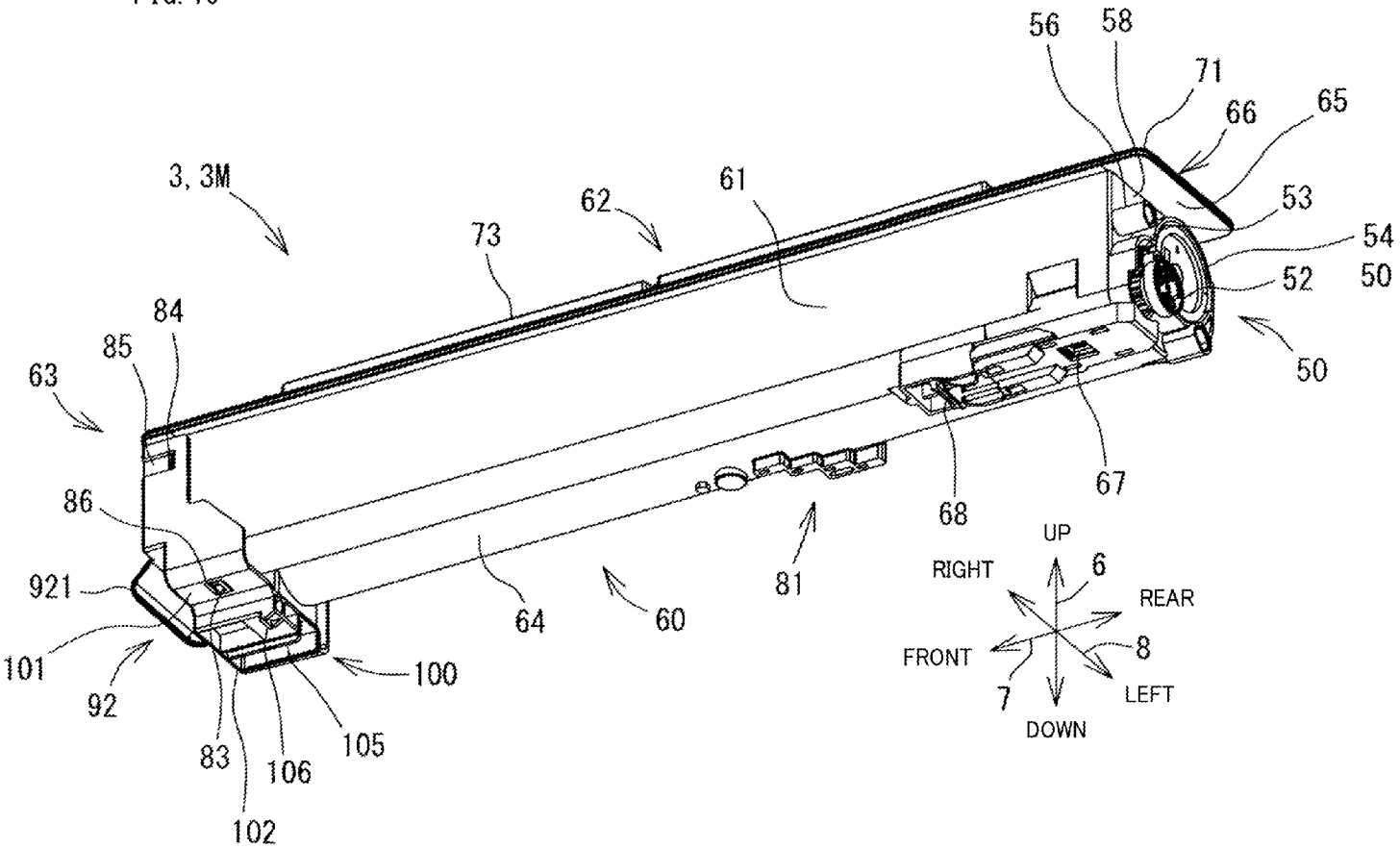
FIG. 10 is a perspective view of the toner container for magenta color.

As shown in FIG. 10, an identifying portion 81 for identifying a unique pattern of the toner container 3M is provided on a lower surface (bottom surface) 64 of the housing 61. The identifying portion 81 is used to determine whether or not the toner container 3M is compatible with the image forming apparatus 10. It is determined that the toner container 3M is compatible with the image forming apparatus 10 if the toner container 3M is inserted into the container attachment portion 30 without interruption of an identification projection (not shown) to the identifying portion 81, the identification projection provided on the bottom surface of the storage chamber 31M. On the other hand, it is determined that the toner container 3M is not compatible with the image forming apparatus 10 if the toner container 3M cannot be inserted into the container attachment portion 30 due to an interruption of the identification projection to the identifying portion 81. The identifying portion 81 is positioned to be slightly closer to the rear side than an approximate center of the lower surface 64 in the front-rear direction 7.

In addition, a supply port 67 and a shutter member 68 are provided on the lower surface 64. The shutter member 68 opens and closes the supply port 67. The supply port 67 is an opening portion through which the toner stored in the toner container 3M is sent to the developing device 44 when the toner container 3M is attached to the attachment position of the container attachment portion 30. The supply port 67 is formed in the vicinity of the rear end of the lower surface 64, close to the right side in the rear end portion.

A transmission portion 50 is provided in the rear end portion of the housing 61. The transmission portion 50 receives a rotational driving force which is input from the image forming apparatus 10 in the attachment state where the toner container 3M is attached to the container attachment portion 30. The transmission portion 50 is provided on a wall surface 58 (see FIG. 10) of the housing 61 located in depth (rear) in the attachment direction in which the toner container 3M is attached to the container attachment portion 30. The transmission portion 50 includes a joint 52, a small diameter gear 53, and a large diameter gear 54. In the attachment state, the joint 52 is connected with a joint (not shown) provided in the container attachment portion 30. A gear is formed on a shaft of the joint 52, and the gear meshes with the small diameter gear 53. The small diameter gear 53 meshes with the large diameter gear 54. The large diameter gear 54 is connected with a stirring paddle (not shown) that is a driving member provided inside the toner container 3M. With this configuration, when the rotational driving force is input to the joint 52 in the attachment state, the transmission portion 50 transmits the rotational driving force to the stirring paddle via the small diameter gear 53 and the large diameter gear 54. Upon receiving the rotational driving force, the stirring paddle rotates.

In addition, as shown in FIG. 10, a pin member 56 is provided in the rear end portion of the housing 61. The pin member 56 projects rearward from the wall surface 58. The pin member 56 is provided at a position that corresponds to a positioning hole (not shown) provided in the container attachment portion 30. When the toner container 3M is attached to the attachment position of the container attachment portion 30, the pin member 56 is inserted in the positioning hole. This allows the toner container 3M to be positioned to the attachment position of the container attachment portion 30, and is thereby attached to the attachment position in a reliable manner.

As shown in FIG. 11 to FIG. 13B, the cover member 63 is attached to a front surface 57 of the housing 61 (see FIG. 14). The cover member 63 covers the front surface 57 of the housing 61 in such a way as to protect a filling port 97 provided in the front surface 57, wherein the filling port 97 is described below.

As shown in FIG. 14, the front surface 57 has the filling port 97 through which the toner is filled in the case main body 60. The filling port 97 is disposed close to the right side in the front surface 57. Projections 84 are respectively formed at opposite ends of the front surface 57 in the left-right direction 8. A projection 84 on the left side projects leftward, and a projection 84 on the right side projects rightward. The cover member 63 is attached to the front surface 57 of the housing 61 by being engaged with the projections 84. Specifically, a pair of engaging holes 85 (see FIG. 11 and FIG. 12) are respectively formed in two opposite sides of the cover member 63 (the sides opposite to each other in the left-right direction 8) that are perpendicular to the front surface 57, and the cover member 63 is attached to the front surface 57 when the projections 84 are inserted into the engaging holes 85.

Figure 11:
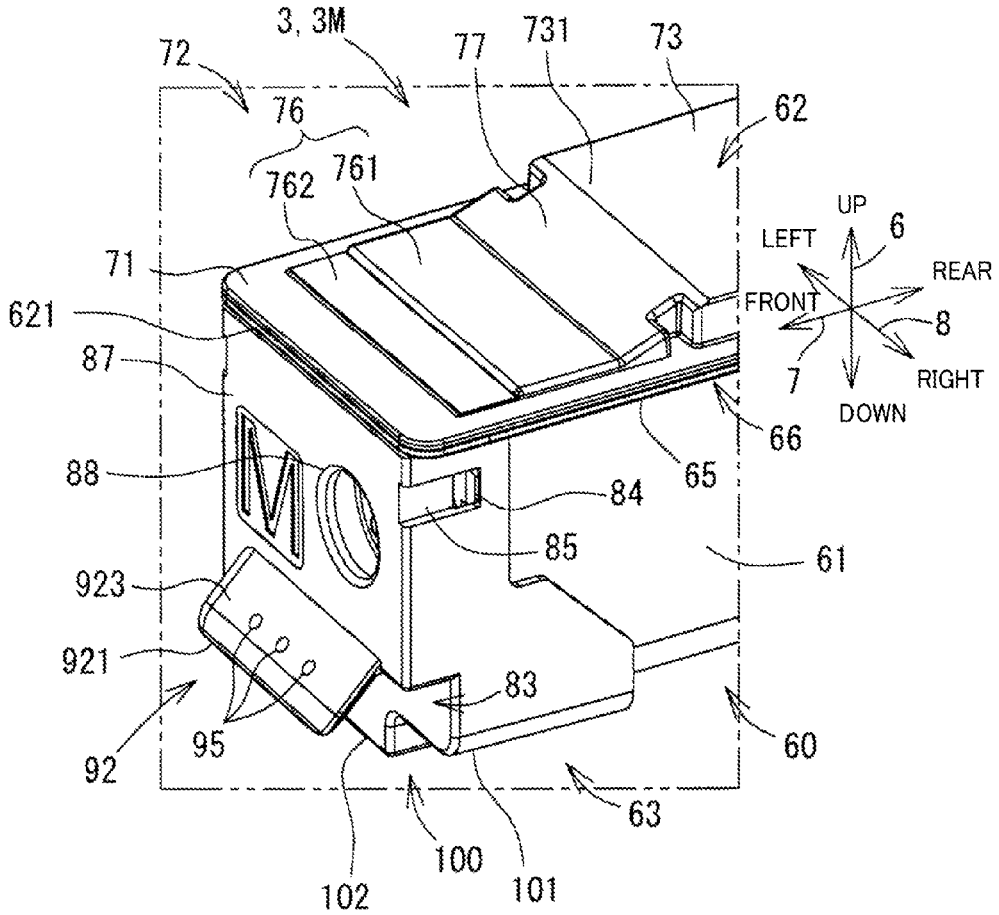
FIG. 11 is a perspective view of a front portion of the toner container for magenta color.

As shown in FIG. 11 and FIG. 12, the handle 92 is provided on a front wall 87 (a front-side end surface) of the cover member 63. The front wall 87 faces the front surface 57 when the cover member 63 is attached to the front surface 57. The handle 92 is gripped by the user when the toner container 3M is attached to or drawn from the container attachment portion 30, or carried.

The handle 92 projects frontward from the front wall 87. More specifically, the handle 92 projects diagonally downward from the front wall 87. The front wall 87 has a circular opening 88 at a position corresponding to the filling port 97. Even in the state where the cover member 63 is attached to the front surface 57, the user can visually recognize the filling port 97 through the opening 88.

The handle 92 is provided below the opening 88. The handle 92 includes a base portion 921 and a side wall portion 922 (closing wall). The base portion 921 projects frontward from the front wall 87. More specifically, the base portion 921 projects diagonally downward from the front wall 87. The root portion of the base portion 921 is connected to the front wall 87. The side wall portion 922 is formed between a left end portion of the base portion 921 and the front wall 87. With the provision of the side wall portion 922, a left space among a space between the base portion 921 and the front wall 87 is closed by the side wall portion 922. It is noted that a side wall portion is not provided in the right end portion of the base portion 921, and as shown in FIG. 12, the right side of the base portion 921 is opened such that a finger of the user can be inserted therein.

As shown in FIG. 12, a recessed portion 89 is formed in the lower portion of the cover member 63. The recessed portion 89 extends in the left-right direction 8 such that opposite ends in the left-right direction 8 are opened. In the present embodiment, the cover member 63 is provided in the lower end side of the front wall 87. Specifically, the cover member 63 is provided at the lower end of the front wall 87 and projects diagonally downward from the lower end. As a result, the handle 92 is disposed more on the front side than the recessed portion 89. Thus the handle 92 and the recessed portion 89 form a space that is sufficient for the user to insert his/her finger therein.

With the provision of the handle 92, the user can insert his/her finger in the opening portion opposite to the side wall portion 922 behind the handle 92, and hook the finger on the handle 92 from below. In addition, with this configuration, since the side wall portion 922 exists on the tip side in the insertion direction of the finger in the space behind the handle 92, the tip of the inserted finger abuts on the side wall portion 922 and the finger is disposed at a fixed position. This facilitates the operation of the handle 92, and thereby facilitates the operation of attaching or detaching the toner container 3M to/from the image forming apparatus 10. That is, the operability of the toner container 3M is improved.

Furthermore, as shown in FIG. 11, a plurality of dotted projections 95 are provided on the surface of the handle 92. The dotted projections 95 are formed on an inclined surface 923 which is an outer surface of the base portion 921 of the handle 92. In the present embodiment, three dotted projections 95 are provided. The dotted projections 95 are each formed in a semispherical shape projecting from the inclined surface 923. Of course, the dotted projections 95 are not limited to the semispherical shape. The dotted projections 95 are disposed at equal intervals along the left-right direction 8 on the surface of the handle 92.

With the provision of the dotted projections 95 on the inclined surface 923 of the handle 92, when the user touches the handle 92 by a groping action, the user can feel the dotted projections 95 on his/her finger. With the feel of the dotted projections 95, the user can recognize the position of the handle 92 and grip it firmly in a reliable manner. As a result, even in the dark, the user can recognize the location of the handle 92 of a toner container 3M attached to the container attachment portion 30, and then grip it to draw the toner container 3M from the container attachment portion 30. In addition, the user can recognize which part of an unattached toner container 3M he/she is gripping from the position of the handle 92, and change the attitude of the toner container 3M to the attachment attitude with reference to the position of the handle 92. Such dotted projections 95 are suitable for a situation where the user works in a low-visibility environment. In addition, such dotted projections 95 are useful for a user with a poor eyesight.

Furthermore, the provision of the dotted projections 95 prevents the finger from slipping when the handle 92 is gripped from above, and facilitates gripping of the handle 92.

As shown in FIG. 12, FIG. 13A and FIG. 13B, a step portion 100 is provided in a lower part of the cover member 63. The step portion 100 is composed of a first stage portion 101 and a second stage portion 102 that are aligned in the left-right direction 8, namely, the short-length direction of the case main body 60. The first stage portion 101 is formed on the right side, and the second stage portion 102 is formed on the left side. The first stage portion 101 and the second stage portion 102 are different in height position. Specifically, the first stage portion 101 is higher in height position than the second stage portion 102. The step between the first stage portion 101 and the second stage portion 102 is sized to allow a finger of the user to be inserted therein.

In the present embodiment, as shown in FIG. 13A and FIG. 13B, the first stage portion 101 is located away downward from a lower end portion 924 of the handle 92, and the second stage portion 102 is located below the first stage portion 101.

The first stage portion 101 has a flat surface that extends from the second stage portion 102 rightward to the right side surface of the case main body 60. An engaging hole 86 is formed in the flat surface of the first stage portion 101 (see FIG. 10). A projection 83 projecting downward (see FIG. 14) is formed on the front side of the lower surface 64 of the housing 61, and the projection 83 is inserted in the engaging hole 86 when the cover member 63 is attached to the front surface 57. This enhances the attachment of the cover member 63 to the housing 61.

As shown in FIG. 12, the rib 105 (compatible shape member) that can be inserted in the groove of the fitting portion 37, is provided on the lower surface of the second stage portion 102. The rib 105 is disposed at a position unique to the toner container 3M. That is, although the rib 105 is provided on each of the toner containers 3Y, 3C and 3M, the positions of the toner containers 3Y, 3C and 3M at which the ribs 105 are disposed differ from each other in the left-right direction 8. In the second stage portion 102, the rib 105 is disposed at a position that corresponds to the fitting portion 37 provided in the storage chamber 31M, namely, at a position that allows the rib 105 to be inserted in the groove of the fitting portion 37 when the toner container 3M is stored in the storage chamber 31M. With this configuration, the toner container 3M is allowed to be attached to the corresponding storage chamber 31M, but other toner containers 3Y and 3C are prohibited from being attached to the storage chamber 31M.

With the provision of the step portion 100 as such, the user can grip the front end portion of the toner container 3M by inserting his/her finger into a gap 107 between the first stage portion 101 and the bottom surface of the storage chamber 31M (see FIG. 13A). As a result, when detaching the toner container 3M from the container attachment portion 30, the user can easily draw the toner container 3M by gripping the front end portion by inserting his/her finger into the gap 107. In addition, when attaching the toner container 3M to the container attachment portion 30, the user can insert the toner container 3M into the storage chamber 31M while putting his/her finger on the first stage portion 101. In this way, this configuration makes it possible to handle the toner container 3M easily during attachment and detachment thereof, and thus improves the operability of the toner container 3M.

In addition, since the lower surface of the cover member 63 is stepped, not flat, the user can easily understand visually that the stepped part is a gripping portion. In particular, since the gap 107 is formed at the bottom surface of the storage chamber 31M, the user can understand at a glance that the first stage portion 101 is a gripping portion. Thus, when detaching the toner container 3M, the user can grip the first stage portion 101 without hesitation.

As shown in FIG. 12, the cover member 63 includes a lock claw 106 (projection for locking) that projects downward from the lower surface thereof. The lock claw 106 is formed on the lower surface of the second stage portion 102. The lock claw 106 projects downward from the lower surface of the second stage portion 102. The lock claw 106 is located away rightward from the rib 105. In the present embodiment, the lock claw 106 is disposed at approximately the center of the lower surface of the cover member 63 in the left-right direction 8. When the toner container 3M is stored in the storage chamber 31M and inserted to a predetermined attachment position, the lock claw 106 reaches and enters the engaging hole 36 (see FIG. 8). This allows the toner container 3M to be locked in the drawing direction (front direction).

[Configuration of Toner Container 3K]

Figure 15:
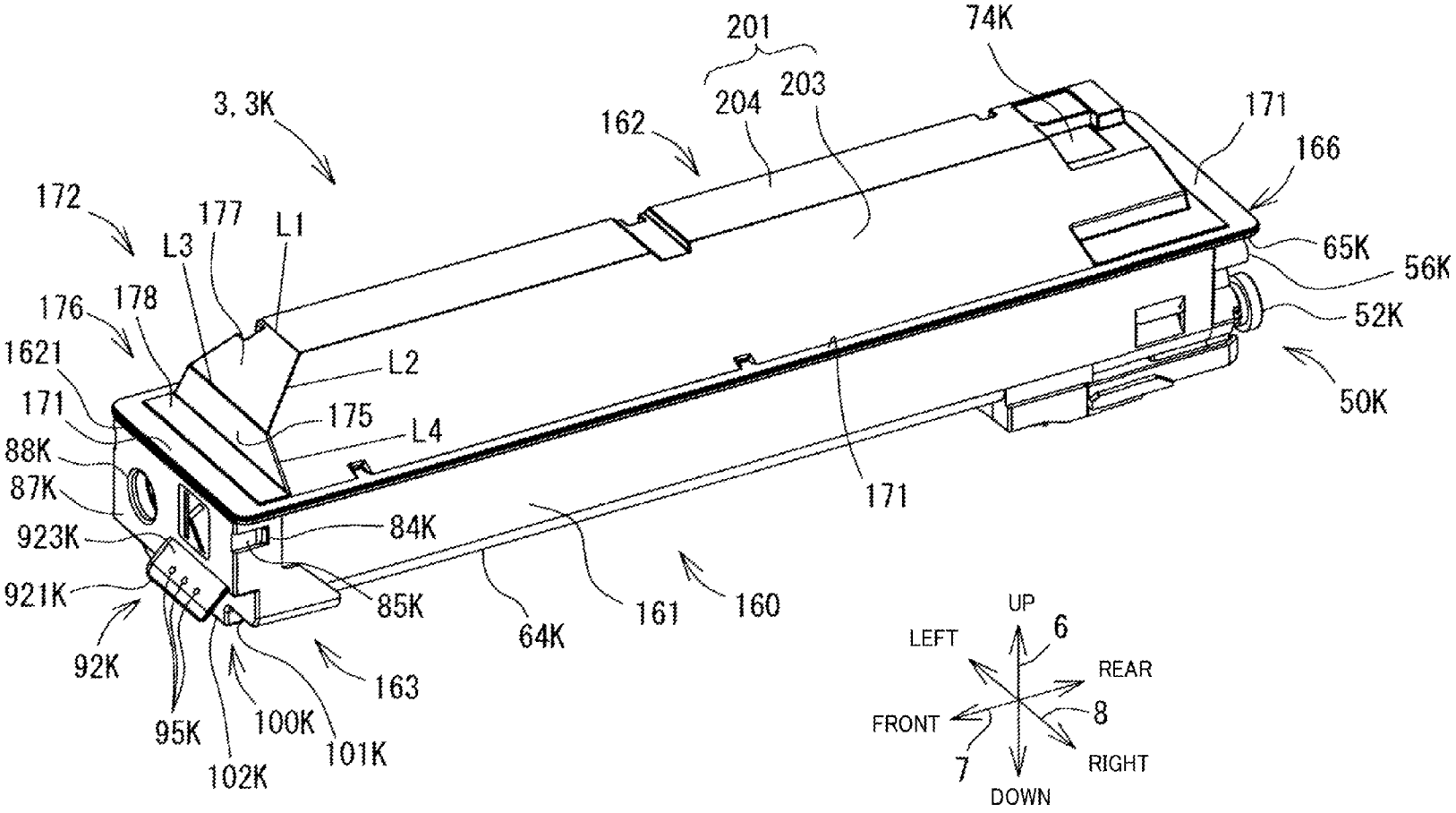
FIG. 15 is a perspective view of a toner container for black color.

The following describes the configuration of the toner container 3K containing black toner with reference to FIG. 15. FIG. 15 is a perspective view of the toner container 3K. The toner container 3K has approximately the same configuration as the other toner containers 3Y, 3C and 3M. Thus, in the following, description of the same configuration is omitted, and different configurations are described in detail. It is noted that, among the components of the toner container 3K, components that are also included in the other toner containers 3Y, 3C and 3M are assigned the same reference signs (for example, handle 92) added with an alphabet K (for example, handle 92K), and description thereof is omitted.

The toner container 3K supplies toner to the developing device 44 of the image forming unit 4K. The toner container 3K is configured to be attachable to and detachable from the container attachment portion 30 provided in the housing 11. Specifically, the toner container 3K is supported so as to be slidable in the front-rear direction 7 so that it can be inserted into and pulled out from the storage chamber 31K which is disposed at the rightmost position in the container attachment portion 30.

A major difference of the toner container 3K from the other toner containers 3Y, 3C and 3M is the shape of the toner container 3K. As described above, the storage chambers 31Y, 31C and 31M in which the toner containers 3Y, 3C and 3M are respectively stored, have the same shape. On the other hand, the storage chamber 31K in which the toner container 3K is stored, is lower in height and wider in the width direction than the other storage chambers 31Y, 31C and 31M. Accordingly, the toner container 3K attached to the storage chamber 31K is formed in a shape which is compatible with the storage chamber 31K, and as a result, is different from the other toner containers 3Y, 3C and 3M in shape. Specifically, the toner container 3K includes a case main body 160 and a cover member 163.

The case main body 160 is long in the front-rear direction 7, and includes a lower housing 161 (lower housing) and an upper housing 162 (upper housing). The lower housing 161, the upper housing 162, and the cover member 163 are synthetic resin products made of synthetic resin such as ABS resin or PET resin.

The lower housing 161 defines a lower space in which the toner is stored, among the inner space of the case main body 160. The lower housing 161 has the same basic configuration as the housing 61, but is larger in horizontal width and smaller in height than the housing 61. As a result, in the attachment state, a flange 65K of the lower housing 161 is located below the flange 65 of the housing 61. As a result, as shown in FIG. 2 and FIG. 3, a first joint portion 166 that is described below is lower than the second joint portion 66 in height position.

The upper housing 162 is provided above the lower housing 161. The upper housing 162 is joined with the lower housing 161 and defines an upper space among the inner space of the case main body 160. An opening portion (upper-surface opening) is formed in the upper surface of the lower housing 161, and a flange 65K is formed at the rim of the opening portion. In addition, an opening portion (lower-surface opening) is formed in the lower surface of the upper housing 162, and a flange 171 which is to be positioned with the flange 65K, is formed at the rim of the opening portion. In the state where the upper housing 162 is disposed above the lower housing 161, and the flange 65K and the flange 171 are put together, the flange 65K and the flange 171 are welded and joined by an impulse welding machine or the like. Hereinafter, a portion where the flange 65K and the flange 171 are joined together is referred to as a first joint portion 166.

The upper housing 162 includes an extension portion 201, which, different from the lids 62 of the other toner containers 3Y, 3C and 3M, projects upward from the flange 171. The extension portion 201 constitutes an upper part of the upper housing 162, and extends in the front-rear direction 7. The inside of the extension portion 201 is hollow. As a result, when the lower housing 161 and the upper housing 162 are joined together, the inner space of the case main body 160 is extended upward from the lower housing 161. A recessed portion 74K is formed in the rear side of the extension portion 201.

The extension portion 201 of the upper housing 162 includes an inclined portion 203 and an apex portion 204. The inclined portion 203 and the apex portion 204 are part of the extension portion 201. The inclined portion 203 is formed on the right side of the extension portion 201, and the apex portion 204 is formed on the left side of the extension portion 201.

The inclined portion 203 has a shape that corresponds to the inclined shape of an inclined surface 18B of the sheet tray 18 that is a ceiling surface of the storage chamber 31K. In the present embodiment, the inclined portion 203 extends diagonally above left at a fixed inclination angle from the first joint portion 166 to the apex portion 204.

In the attachment state where the toner container 3K is attached to the storage chamber 31K, the lower housing 161 is formed such that the flange 65K, which is at the upper end of the lower housing 161, is the same as the upper end 39 of the side wall 33R in height position. As a result, the first joint portion 166 is disposed at a height position that is approximately the same as that of the upper end 39 of the side wall 33R.

The apex portion 204 is located immediately below the horizontal surface 18C of the sheet tray 18. The upper surface of the apex portion 204 is a flat surface that faces the horizontal surface 18C, and is at the same height position as the upper surfaces of the other adjacent toner containers 3Y, 3C and 3M.

A step portion 172 is formed on the front side of the extension portion 201. The step portion 172 is formed on an end portion on the front side of the upper housing 162. The step portion 172 includes a first inclined surface 177 (upper step portion), a second inclined surface 175, and a lower stage portion 176, wherein the first inclined surface 177 is formed on the front end portion of the apex portion 204 and extends diagonally downward, the second inclined surface 175 extends downward from the lower end of the first inclined surface 177, and the lower stage portion 176 extends frontward from the second inclined surface 175. The first inclined surface 177, the second inclined surface 175, and the lower stage portion 176 are disposed in alignment in the front-rear direction 7. The second inclined surface 175 is inclined at a larger angle than the first inclined surface 177. In the present embodiment, the first inclined surface 177 is inclined at an approximate angle of 20 to 30 degrees, and the second inclined surface 175 is inclined at an approximate angle of 60 to 70 degrees. The lower stage portion 176 is lower than the apex portion 204, and, of course, lower than the first inclined surface 177 in height position. In other words, the lower stage portion 176 is lower than the apex portion 204 and the first inclined surface 177.

In the present embodiment, the lower stage portion 176 is disposed more on the front side than the first inclined surface 177 and extends from the second inclined surface 175 to a front-side edge 1621 of the upper housing 162. The lower stage portion 176 has a flat plane (flat surface) in a region that extends from the lower end of the second inclined surface 175 to the edge 1621. In addition, the lower stage portion 176 includes a stage portion 178 of a small step (small stage portion) in a region that extends from the second inclined surface 175 to the flange 171. The upper surface of the stage portion 178 is a flat plane (flat surface). The difference in height between the stage portion 178 and the flange 171 is small, less than 1 mm.

As described above, with the provision of the step portion 172 in the toner container 3K, when attaching the toner container 3K to the container attachment portion 30, or when drawing the toner container 3K from the container attachment portion 30, the user can insert his/her finger into the gap between the lower stage portion 176 and the sheet tray 18. This makes it possible for the user to handle the toner container 3K easily while putting his/her finger on the lower stage portion 176.

It is noted that the toner container 3K includes a step portion 100K that is similar to the step portion 100 provided in each of the toner containers 3Y, 3C and 3M, but no member like the rib 105 is provided in a second stage portion 102K of the step portion 100K.

In addition, the toner container 3K includes a transmission portion 50K that is similar to the transmission portion 50 provided in each of the toner containers 3Y, 3C and 3M, but among the components constituting the transmission portion 50K, a large diameter gear 54K is different from the large diameter gear 54 of the transmission portion 50 in disposition. Specifically, as shown in FIG. 7, the position at which the large diameter gear 54K is disposed in the toner container 3K is lower than the position at which the large diameter gear 54 is disposed in each of the toner containers 3Y, 3C and 3M. Following this, a small diameter gear 53K is disposed more on the left side than a joint 52K. As described above, the lower housing 161 of the toner container 3K is smaller in height and larger in width than the housings 61 of the toner containers 3Y, 3C and 3M. As a result, in the transmission portion 50 and the transmission portion 50K that have gears and the like of the same size, the transmission path of the transmission portion 50K is designed to be closer to the horizontal direction than the transmission path of the transmission portion 50.

As described above, the toner container 3K includes the upper housing 162 that includes the inclined portion 203. In addition, in the attachment state, the first joint portion 166 from which the inclined portion 203 starts to be inclined, is at approximately the same height as the upper end 39 of the side wall 33R. With this configuration, the toner container 3K can be suitably attached to the storage chamber 31K of the container attachment portion 30 that is disposed on the right side in the storage space 22, while ensuring a larger capacity for the toner container 3K than for each of the other toner containers 3Y, 3C and 3M. This makes it possible to reduce a wasteful space around the toner container 3K in the image forming apparatus 10, specifically a space between the side wall 33R of the storage chamber 31K and the sheet discharge portion 15.

In addition, due to the configuration where the second joint portion 66 in the toner containers 3Y, 3C and 3M is higher in position than the first joint portion 166, a storage space for storing the toner can be ensured by only the housing 61. This makes it possible for the housing 61 and the lid 62 to be formed in a relatively simple shape, thereby reducing the production cost.

It is noted that in the above-described embodiment, a configuration where the toner containers 3Y, 3C, 3M and 3K include the cover members 63 and 63K is presented as one example. However, the present disclosure is not limited to this configuration. For example, the present disclosure may have a configuration where the cover member 63 is not provided, and the handle 92, the step portion 100 and the like are formed in the case main body 60.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a case storage portion configured to store a plurality of toner cases containing toner, in alignment in a predetermined direction;

the plurality of toner cases attached to the case storage portion, formed to be long in an attachment direction with respect to the case storage portion;

an image forming portion configured to form an image on a sheet member by using the toner supplied from the plurality of toner cases; and a tray disposed above the case storage portion in such a way as to constitute a ceiling surface of the case storage portion and configured to hold the sheet member after the image is formed on the sheet member, wherein the case storage portion is provided in a storage space formed below the tray, and includes a side wall located at one of opposite ends of the case storage portion opposing in a width direction of the case storage portion, the tray includes an inclined surface and a horizontal surface that constitute the ceiling surface, the inclined surface extending diagonally upward from one of opposite ends of the tray in a width direction of the tray toward the other of the opposite ends, passing a support point being an upper end of the side wall, and further extending diagonally upward at a same inclination angle from the support point, the horizontal surface horizontally extending from an end of the inclined surface that is on a side of the other of the opposite ends of the tray, toward the other of the opposite ends of the tray, a first toner case, one of the plurality of toner cases that is disposed closest to the one side wall, includes a lower housing defining a lower space and an upper housing defining an upper space among an inner space of the first toner case, a rim of an upper-surface opening of the lower housing and a rim of a lower-surface opening of the upper housing being joined together, a second toner case that is adjacent to the first toner case, includes a housing main body storing toner and a flat lid that covers an upper-surface opening of the housing main body, a rim of the upper-surface opening of the housing main body and a rim of the lid being joined together, the upper housing of the first toner case includes an inclined portion that is inclined corresponding to the inclined surface of the tray and disposed immediately below the inclined surface, the lid of the second toner case is disposed immediately below the horizontal surface of the tray, and a first joint portion at which the lower housing and the upper housing of the first toner case are joined together, is lower in height than a second joint portion at which the housing main body and the lid of the second toner case are joined together.

2. The image forming apparatus according to claim 1, wherein the first toner case has a larger capacity than the second toner case.

3. The image forming apparatus according to claim 2, wherein the first toner case contains a black toner, and the second toner case contains a color toner.

4. The image forming apparatus according to claim 1 further comprising:

a transmission portion connected with a driving member provided inside each of the plurality of toner cases, and configured to transmit a driving force to the driving member, wherein the transmission portion is attached to a wall surface of the toner case located in depth in the attachment direction.

* * * * *